US009804554B2

(12) United States Patent
Hatano

(10) Patent No.: US 9,804,554 B2
(45) Date of Patent: Oct. 31, 2017

(54) IMAGE FORMING APPARATUS

(71) Applicant: CANON KABUSHIKI KAISHA, Tokyo (JP)

(72) Inventor: Fukashi Hatano, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/967,471

(22) Filed: Dec. 14, 2015

(65) Prior Publication Data

US 2016/0187841 A1 Jun. 30, 2016

(30) Foreign Application Priority Data

Dec. 26, 2014 (JP) ..... 2014-266603

(51) Int. Cl.

| | |
|---|---|
| ***G03G 21/00*** | (2006.01) |
| ***G03G 21/16*** | (2006.01) |
| ***G03G 15/16*** | (2006.01) |
| *G03G 15/00* | (2006.01) |

(52) U.S. Cl.

CPC ..... *G03G 21/1647* (2013.01); *G03G 15/1615* (2013.01); *G03G 21/168* (2013.01); *G03G 15/757* (2013.01); *G03G 2221/1657* (2013.01)

(58) Field of Classification Search

CPC ..... G03G 15/1615; G03G 21/1647; G03G 21/186; G03G 2221/1642; G03G 2221/1657; G03G 15/1605; G03G 21/168; G03G 2215/0132; G03G 2221/1684

See application file for complete search history.

(56) References Cited

U.S. PATENT DOCUMENTS 9,335,720 B1 * 5/2016 Omura ..... G03G 15/161
2007/0286649 A1 * 12/2007 Kawasumi ..... G03G 21/1633 399/296

(Continued)

FOREIGN PATENT DOCUMENTS

| | | |
|---|---|---|
| EP | 2 211 235 A1 | 7/2010 |
| JP | 2005-76734 A | 3/2005 |
| JP | 2011-191584 A | 9/2011 |

OTHER PUBLICATIONS

Search Report issued in European Patent Application No. 15199829.1, dated May 12, 2016.
U.S. Appl. No. 14/991,378, filed Jan. 8, 2016, Fukashi Hatano.

*Primary Examiner* — Clayton E Laballe
*Assistant Examiner* — Ruifeng Pu
(74) *Attorney, Agent, or Firm* — Fitzpatrick, Cella, Harper & Scinto

(57) ABSTRACT

An image forming apparatus includes a rotatable first coupling provided at a side surface of an engaging portion with a taper surface, and a unit detachably mountable in a second direction crossing with the first direction. The unit includes a second coupling, a driven member and a releasing member. The second coupling includes at an end portion thereof a portion-to-be-engaged engageable with the engaging portion to transmit the driving force, and the driven member receives the driving force from the second coupling. When the unit is disengaged from the main assembly, the releasing member is moved in the second direction in contact with the taper surface to move the first coupling away from the second coupling to effect disengagement between the engaging portion and the portion-to-be-engaged.

12 Claims, 12 Drawing Sheets

(56) References Cited

U.S. PATENT DOCUMENTS

| | | | | |
|---|---|---|---|---|
| 2010/0189462 | A1* | 7/2010 | Kawashima | G03G 21/186 399/110 |
| 2010/0310274 | A1* | 12/2010 | Matsunai | G03G 15/50 399/207 |
| 2013/0195506 | A1* | 8/2013 | Yamaguchi | G03G 15/0194 399/121 |
| 2015/0117918 | A1* | 4/2015 | Suzuki | G03G 15/757 399/320 |
| 2015/0160608 | A1* | 6/2015 | Sawashima | G03G 21/186 399/167 |
| 2015/0241818 | A1* | 8/2015 | Kawashima | G03G 15/1605 399/313 |
| 2015/0253697 | A1* | 9/2015 | Hatano | G03G 15/1615 399/121 |
| 2015/0277298 | A1* | 10/2015 | Suzuki | G03G 15/168 399/101 |
| 2015/0307307 | A1* | 10/2015 | Goto | G03G 21/168 399/13 |
| 2016/0091837 | A1* | 3/2016 | Morita | G03G 21/1647 399/298 |
| 2016/0170336 | A1* | 6/2016 | Oba | G03G 15/1615 399/302 |
| 2016/0195835 | A1* | 7/2016 | Toso | G03G 15/161 399/101 |
| 2016/0202640 | A1* | 7/2016 | Hatano | G03G 15/1605 399/121 |

* cited by examiner

IMAGE FORMING APPARATUS

FIELD OF THE INVENTION AND RELATED ART

The present invention relates to an image forming apparatus such as a copying machine, a printer, and a facsimile machine which uses an electrophotographic or electrostatic recording method.

Generally speaking, an image forming apparatus which uses an electrophotographic image forming method, for example, uniformly charges the peripheral surface of its photosensitive component, which is in the form of a drum or belt, and writes an electrostatic latent image on the charged surface of the photosensitive component, in accordance with image formation signals. Then, it develops the electrostatic latent image with the use of toner. Then, it transfers the toner image on the photosensitive component directly onto transfer medium such as a sheet of recording paper conveyed by a transfer medium conveying component, or temporarily transfers (primary transfer) the toner image on the photosensitive component onto an intermediary transferring component, and then, onto the transfer medium (secondary transfer). As recording conveying component and intermediary transfer medium, a transfer medium bearing belt and an intermediary transfer belt, which are endless belts, are widely used, respectively.

It is possible that the intermediary transfer belt, for example, of an image forming apparatus such as the one described above will suffer from such a trouble that it breaks because of its fatigue attributable to elapse of time and/or cumulative length of time it has been driven. Therefore, it is desired that the intermediary transfer belt or the like is periodically replaced. Thus, it is a common practice to integrate the intermediary transfer belt, and multiple rollers (including driver roller) by which the belt is suspended and kept tensioned, into a unit (intermediary transfer belt unit), which can be removably installable in the main assembly of an image forming apparatus.

The main assembly of an image forming apparatus, into which the abovementioned unit is removably mountable, is provided with a driving force source, and a component to which driving force is transmitted from the driving force source. Generally speaking, the main assembly and intermediary transfer belt unit are structured so that the unit is pulled out, or inserted into, the main assembly in the direction which is parallel to the axial line of the driver roller of the unit. Thus, the unit is pulled out, or inserted into, the main assembly in the direction which is roughly perpendicular to the lateral plates of the frame of the main assembly. Therefore, one of the lateral plates of the main assembly has to be provided with a relatively large hole. Providing one of the lateral plates of the main assembly with a relatively large hole is likely to reduce the main assembly in rigidity, making it necessary, in some cases, to provide the main assembly with additional structural components. Providing the main assembly with additional structural components is likely to complicate the main assembly in structure, and also, to increase the main assembly in cost. This problem is exacerbated in a case where the intermediary transfer belt unit is relatively large in dimension in terms of the direction which is roughly perpendicular to the shaft of the driver roller of the unit.

As means for dealing with the above-described problem, it is possible to structure an image forming apparatus, and its belt unit, in such a manner that the belt unit is pulled out of, or inserted into, the main assembly of the apparatus, in the direction which is roughly parallel to the lateral plates of the frame of the main assembly of the apparatus. In such a case, the unit has to be pulled out of, or inserted into, the main assembly in the direction which is roughly perpendicular to the shaft of the driver roller of the unit. Therefore, the main assembly and unit have to be structured so that when the unit is installed into, or removed from, the main assembly, a coupling or the like of the main assembly becomes disengaged from the counterpart of the unit.

One of the structural arrangements for disengaging the coupling or the like of the main assembly of an image forming apparatus from the counterpart of the belt unit is disclosed in Japanese Laid-open Patent Application No. 2011-191584. According to this application, the main assembly of the apparatus is provided with a component which can be moved by the handle of the belt unit. Further, the image forming apparatus and the belt unit therefor are structured so that as the handle of the unit is operated (pulled, for example) by a user to pull the unit out of, or insert the unit into the main assembly, the coupling of the main assembly is disengaged from the counterpart of the unit.

However, in the case of an image forming apparatus structured like the image forming apparatus disclosed in Japanese Laid-open Patent Application No. 2011-191584, the linkage for retracting the coupling of the main assembly is made up of a large number of components. The greater the linkage in component count, the greater it is in the possibility in which it will malfunction. Further, if the linkage malfunctions, such a situation that the unit cannot be pulled out of the main assembly, that is, the unit cannot be replaced, will possibly occur. In the worst case, the entirety of the main assembly may have to be replaced. Moreover, the increase in component count leads to cost increase.

SUMMARY OF THE INVENTION

According to an aspect of the present invention, there is provided an image forming apparatus comprising a main assembly; a driving source provided in said main assembly; a first coupling provided in said main assembly and rotatable by a driving force from said driving source, said first coupling is capable of transmitting the driving force by an engaging portion provided at an end portion thereof and being movable in a first direction which is a direction of a rotational axis of said first coupling, said first coupling being provided at a side surface of said engaging portion with a coupling taper surface having a diameter which increases in the first direction from a free end portion toward said driving source; and a unit detachably mountable to said main assembly in a second direction crossing with the first direction, said unit including a second coupling, a driven member and a releasing member, wherein said second coupling includes at an end portion thereof a portion-to-be-engaged engageable with said engaging portion to transmit the driving force from said driving source, said driven member receives the driving force from said second coupling, and when said unit is disengaged from said main assembly, said releasing member is moved in the second direction in contact with the coupling taper surface to move said first coupling away from said second coupling to effect disengagement between said engaging portion and said portion-to-be-engaged.

According to another aspect of the present invention, there is provided an image forming apparatus comprising a main assembly; a driving source provided in said main assembly; a first coupling provided in said main assembly and rotatable by a driving force from said driving source, said first coupling is capable of transmitting the driving force by an engaging portion provided at an end portion thereof; and a unit detachably mountable to said main assembly in a second direction crossing with a first direction which is a direction of a rotational axis of said first coupling, said unit including a second coupling, a driven member and a releasing member, wherein said second coupling includes at an end portion thereof a portion-to-be-engaged engageable with said engaging portion to transmit the driving force from said driving source, and said second coupling is movable in the first direction, wherein said second coupling is provided at a side surface of said portion-to-be-engaged with a coupling taper surface having a diameter increasing toward said unit from a free end portion in the first direction, said driven member receives the driving force from said second coupling, and when said unit is disengaged from said main assembly, said releasing member is moved in the second direction in contact with the coupling taper surface to move said second coupling away from said first coupling to effect disengagement between said engaging portion and said portion-to-be-engaged.

Further features of the present invention will become apparent from the following description of exemplary embodiments with reference to the attached drawings.

DESCRIPTION OF THE EMBODIMENTS

Hereinafter, a couple of image forming apparatuses which are in accordance with the present invention are described in detail with reference to appended drawings.

Embodiment 1

1. Overall Structure and Operation of Image Forming Apparatus

Figure 1:
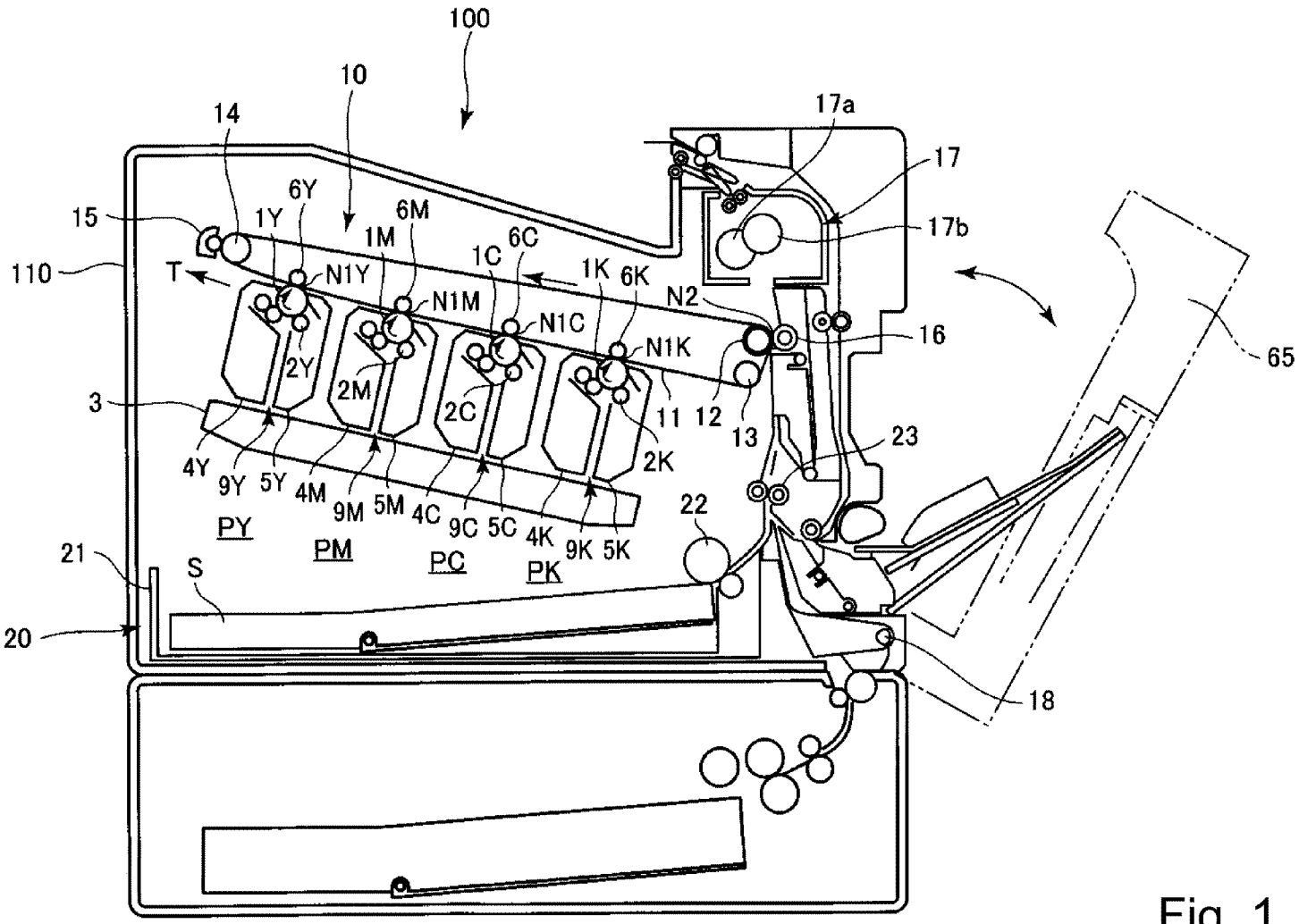
FIG. 1 is a vertical sectional view of the image forming apparatus in the first embodiment of the present invention.

FIG. 1 is a vertical sectional view of the image forming apparatus in the first embodiment of the present invention. The image forming apparatus 100 in this embodiment is capable of forming full-color images with the use of an electrophotographic image forming method. More specifically, it is a laser beam printer of the so-called tandem type, and also, of the so-called intermediary transfer type.

The image forming apparatus 100 has multiple image forming sections, more specifically, the first, second, third, and fourth image forming sections PY, PM, PC and PK, which form yellow (Y), magenta (M), cyan (C) and black (K) images, respectively.

By the way, in this embodiment, the image forming sections PY, PM, PC and PK are practically the same in structure and operation, although they are different in the color of the toner they use. Hereafter, therefore, they are described together. That is, the suffixes Y, M, C and K which indicate the color of monochromatic toner images they form are not shown unless they need to be shown for specific reasons.

The image forming apparatus 100 has photosensitive drums 1, which are electrophotographic photosensitive components (photosensitive components), as image bearing components, which are in the form of a drum (cylindrical). Each photosensitive drum 1 is rotationally driven in the clockwise direction in FIG. 1. The image forming apparatus 100 is also provided with various drum processing means, more specifically, a charge roller 2 as a charging means, a developing device 4 as a developing means, and a drum cleaning device 5 as a photosensitive component cleaning means. These drum processing means are in the adjacencies of the peripheral surface of the drum 1.

Further, the image forming apparatus 100 has an exposing device 3 (laser scanner) as an exposing means, which is disposed so that it can expose the peripheral surface of each of the photosensitive drums 1Y, 1M, 1C and 1K.

The image forming apparatus 100 has also an intermediary transfer belt unit 10, as a belt-based conveying device, which is disposed so that it opposes each of the photosensitive drums 1Y, 1M, 1C and 1K. The intermediary transfer belt unit 10 has an intermediary transfer belt 11, as an intermediary transferring component, which is an endless belt. The intermediary transfer belt 11 is disposed so that it opposes each of the photosensitive drums 1Y, 1M, 1C and 1K. It is suspended and kept tensioned by multiple rollers (suspending-tensioning components), more specifically, a driver roller 12, an idler roller 13, and a tension roller 14. As the driver roller 12 is rotationally driven, the intermediary transfer belt 11 is circularly moved in the clockwise direction in FIG. 1, by the rotation of the driver roller 12. The tension roller 14 is kept pressured outward of the loop which the intermediary transfer belt 11 forms, from within the loop, as indicated by an arrow mark T in FIG. 1, as will be described later in detail. Thus, the intermediary transfer belt 11 is provided with a preset amount of tension. Moreover, the image forming apparatus 100 is provided with primary transferring components as primary transferring means, more specifically, primary transfer rollers 6Y, 6M, 6C and 6K, which are disposed on the inward side of the belt loop, being positioned so that they oppose the photosensitive drums 1Y, 1M, 1C and 1K, respectively. The primary transfer roller 6 is kept pressed against the photosensitive drum 1, by a preset amount of pressure, with the presence of the intermediary transfer belt 11 between itself and photosensitive drum 1, forming thereby a primary transferring section N1, which is the area of contact between the intermediary transfer belt 11 and peripheral surface of the photosensitive drum 1. Further, the image forming apparatus 100 is provided with a secondary transferring component as the secondary transferring means, more specifically, a secondary transfer roller 16, which is disposed on the outward side of the belt loop, being positioned so that it opposes the driver roller 12. The secondary transfer roller 16 is kept pressed against the driver roller 12, with the presence of the intermediary transfer belt 11 between itself and the driver roller 12, forming thereby a secondary transferring section N2, which is the area of contact between the intermediary transfer belt 11 and secondary transfer roller 16. Further, the image forming apparatus 100 is provided with a belt cleaning device 15, as an intermediary transfer belt cleaning means, which is disposed on the outward side of the belt loop, being positioned so that it opposes the tension roller 14.

Furthermore the image forming apparatus 100 is provided with a feeding-conveying device 20 which conveys a sheet S of transfer medium to the secondary transferring section N2, a fixing device which fixes a toner image to the sheet S, etc.

In this embodiment, the photosensitive drum 1, charge roller 2, exposing device 3 used to form images which are different in color, developing device 4, primary transfer roller 6, drum cleaning device 5, etc., make up an image forming section P for forming images which are different in color. Further, the charge roller 2, developing device 4, and cleaning device 5, which are the means for processing the photosensitive drum 1, are integrated in the form of a process cartridge 9 which is removably installable in the main assembly 110 of the image forming apparatus 100.

During an image forming operation, the photosensitive drum 1 is rotated in the clockwise direction in FIG. 1. As the photosensitive drum 1 is rotated, the peripheral surface of the photosensitive drum 1 is uniformly charged by the charge roller 2, and is scanned (exposed) by the exposing device 3. As a result, an electrostatic latent image (electrostatic image) is formed on the peripheral surface of the photosensitive drum 1. This electrostatic latent image formed on the peripheral surface of the photosensitive drum 1 is developed into a toner image (image formed of toner) by the developing device 4 which uses toner as developer. In this embodiment, the electrostatic latent image is reversely developed. More concretely, as the peripheral surface of the photosensitive drum 1 is uniformly charged, and exposed, the exposed points of the peripheral surface of the photosensitive drum 1 reduce in potential, in terms of absolute value. Then, toner charged to the same polarity as the polarity to which the photosensitive drum 1 is charged is adhered to these points having a reduced in potential level, effecting thereby a toner image.

After the formation of a toner image on the peripheral surface of the photosensitive drum 1, the toner image is transferred (primary transfer) by the function of the primary transfer roller 6 onto the intermediary transfer belt 11 which is being rotated in the counterclockwise direction in FIG. 1, in the primary transferring section N1. During this transfer, the primary transfer voltage (primary transfer bias), which is DC voltage and is opposite in polarity (positive in this embodiment) from the polarity to which toner is charged for development, is applied to the primary transfer roller 6 by a primary transfer power source (unshown) as a voltage applying means. For example, in an operation for forming a full-color image, toner images formed on the photosensitive drums 1Y, 1M, 1C, and 1K, one for one, are sequentially transferred in layers onto the intermediary transfer belt 11.

After the transfer of the toner images onto the intermediary transfer belt 11, the toner images are transferred (secondary transfer) by the function of the secondary transfer roller 16, onto a sheet S of transfer medium such as recording paper, which is being conveyed through the secondary transferring section N2, remaining pinched by the intermediary transfer belt 11 and secondary transfer roller 16. During this transfer, the secondary transfer voltage (secondary transfer bias), the polarity of which is opposite (positive in this embodiment) from the polarity to which toner remains charged during development is applied to the secondary transfer roller 16 from a secondary transfer power source (unshown) as a voltage applying means. For example, in an image forming operation for forming a full-color image, after the transfer, in layers, of four monochromatic toner images, different in color, onto the intermediary transfer belt 11, the toner images are conveyed by the intermediary transfer belt 11 to the secondary transferring section N2, in which they are transferred together onto the sheet S of transfer medium, which was fed into a transfer medium cassette 21 or the like into the main assembly of the image forming apparatus 100 by a sheet feeding-conveying device 20, and was delivered to the secondary transferring section N2 by a pair of registration rollers 23 with the same timing as the toner images on the intermediary transfer belt 11.

After the transfer of the toner images onto the sheet S of transfer medium, the sheet S is conveyed to the fixing device 17, in which the sheet S and toner images thereon are heated and pressed in the fixation nip between the fixation roller 17*a* and pressure roller 17*b* with which the fixing device 17 is provided. Thus, the unfixed toner images on the surface of the sheet S become fixed to the surface of the sheet S. Thereafter, the sheet S is discharged (outputted) out of the image forming apparatus 100.

Meanwhile, the toner (primary transfer residual toner) remaining on the peripheral surface of the photosensitive drum 1 after the primary transfer is removed from the photosensitive drum 1, and recovered, by the drum cleaning device 5. More concretely, as the photosensitive drum 1 is rotated, the residual toner on the peripheral surface of the photosensitive drum 1 is scraped away by the cleaning blade, as a cleaning component, with which the cleaning device 5 is provided. As for the toner (secondary transfer residual toner) remaining on the surface of the intermediary transfer belt 11 after the secondary transfer, it is removed from the intermediary transfer belt 11 by the belt cleaning device 15. More concretely, as the intermediary transfer belt 11 is rotated, the toner remaining on the surface of the intermediary transfer belt 11 is scraped away by a cleaning blade, as a cleaning component, with which the belt cleaning device 15 is provided. As the secondary transfer residual toner is removed from the intermediary transfer belt 11, it is recovered into a container for recovered toner, through a passage (unshown) for the recovered toner.

2. Intermediary Transfer Belt Unit

Next, the intermediary transfer belt unit 10 (which may be referred to simply as "unit", hereafter) in this embodiment is described further. By the way, regarding the orientation of the image forming apparatus 100 and its elements, the side of the image forming apparatus 100, which is facing the viewers of FIG. 1, is referred to as "front side", and the side which corresponds to the rear side of the sheet of paper, on which FIG. 1 is drawn, is referred to as "rear side". Further, the left and right sides of the image forming apparatus 100 and its elements, which are on the left and right side of the apparatus 100 as seen from the front side are referred to as the left and right sides, respectively. The depth direction, or the direction which is perpendicular to the front and rear surface of the image forming apparatus 100, is roughly parallel to the axial line of each photosensitive drum 1, axial line of each of the rollers 12, 13 and 14 by which the intermediary transfer belt 11 is suspended and kept tensioned. Further, regarding the orientation of the unit 10 and its elements, the direction which is parallel to the width direction of the intermediary transfer belt 11 (which is roughly perpendicular to transfer medium conveyance direction) may be referred to as "thrust direction".

Figure 2:
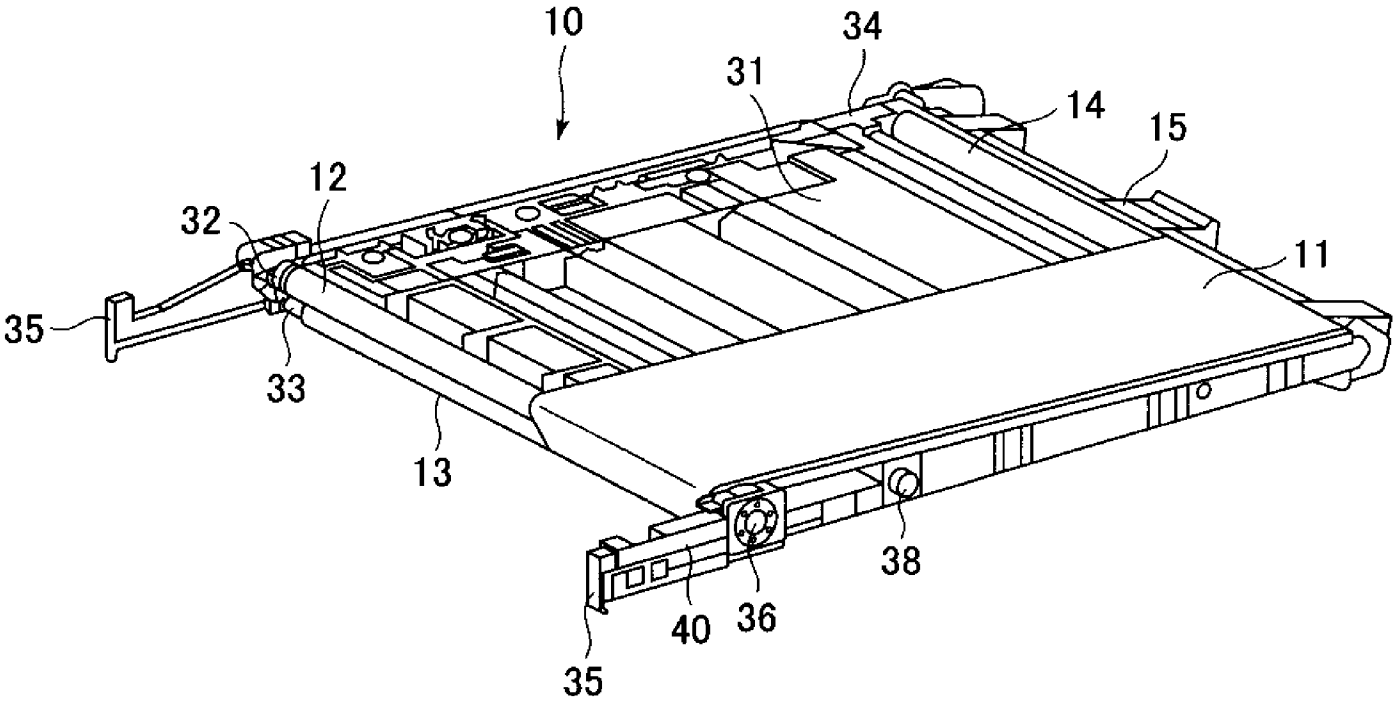
FIG. 2 is a perspective view of the intermediary transfer belt unit.

FIG. 2 is a perspective view of the unit 10. The unit 10 is removably installable in the main assembly 110 of the image forming apparatus 100. The unit has the intermediary transfer belt 11 (FIG. 2 does not show part of front section of intermediary transfer belt). Further, the unit 10 has multiple rollers, more concretely, the driver roller 12, idler roller 13, and tension roller 14, by which the intermediary transfer belt 11 is suspended. The driver roller 12, idler roller 13, and tension roller 14 are attached to the unit frame 31.

The driver roller 12 is rotatably supported; the lengthwise ends of the driver roller 12 in terms of the direction parallel to the rotational axis of the driver roller 12 are rotatably supported by a pair of driver roller bearings 31 (FIG. 2 shows only front bearing), one for one, which are fixed to the unit frame 31. As will be described later in detail, the driver roller 12 is rotated by the driving force transmitted thereto from a driving force source (unshown) with which the main assembly 110 of the image forming apparatus 100 (which hereafter may be referred to as "apparatus main assembly"). As the driver roller 12 is rotationally driven, the intermediary transfer belt 11 is circularly moved. By the way, in order to ensure that the intermediary transfer belt 11 and driver roller 12 do not slip relative to each other as the intermediary transfer belt 11 is circularly moved by the rotation of the driver roller 12, the surface layer of the driver roller 12 is formed of rubber which is high in coefficient of friction.

The idler roller 13 is rotatably supported; the lengthwise ends of the idler roller 13 in terms of the direction parallel to its rotational axis (lengthwise direction) are rotatably supported by a pair (FIG. 2 shows only front bearing) of idler roller bearings 33, one for one, which are fixed to the unit frame 31. The idler roller 13 is rotated by the rotation of the intermediary transfer belt 11.

The tension roller 14 is rotatably supported; the lengthwise ends of the tension roller 14 in terms of the direction parallel to its rotational axis (lengthwise direction) are rotatably supported by a pair (FIG. 2 shows only front bearing) of tension roller bearings 34, one for one, which are attached to the unit frame 31 in such a manner that they are allowed to move (slide) relative to the unit frame 31. Both of the tension roller bearings 34 by which the lengthwise ends of the tension roller 14 in terms of the direction parallel to the axial line of the tension roller 14 are rotatably supported are kept pressed by the pressure generated by compression springs (unshown) as pressure applying means, in the direction to cause the tension roller bearings 34 to move (slide) from the inward side of the loop (belt loop) which the intermediary transfer belt 11 forms, toward the outward side. Thus, the tension roller 14 are pressed outward of the belt loop from within the belt loop, providing thereby the intermediary transfer belt 11 with a preset amount of tension.

The belt unit 10 is provided with the belt cleaning device 15, which is positioned so that it opposes the tension roller 14. Further, the unit 10 is provided with a pair of handles 35 which are positioned at the lengthwise ends, one for one, of the driver roller 12 in terms of the direction parallel to the rotational axis of the driver roller 12 and that of the idler roller 13. The handles 35 are used for installing the unit 10 into, or removing the unit 10, from the apparatus main assembly 110. Each handle 35 is protrusive from the unit 10 in the direction in which the unit 10 is inserted into, or pulled out of, the apparatus main assembly 110.

3. Installation and Uninstallation of Intermediary Transfer Belt Unit

Figure 3:
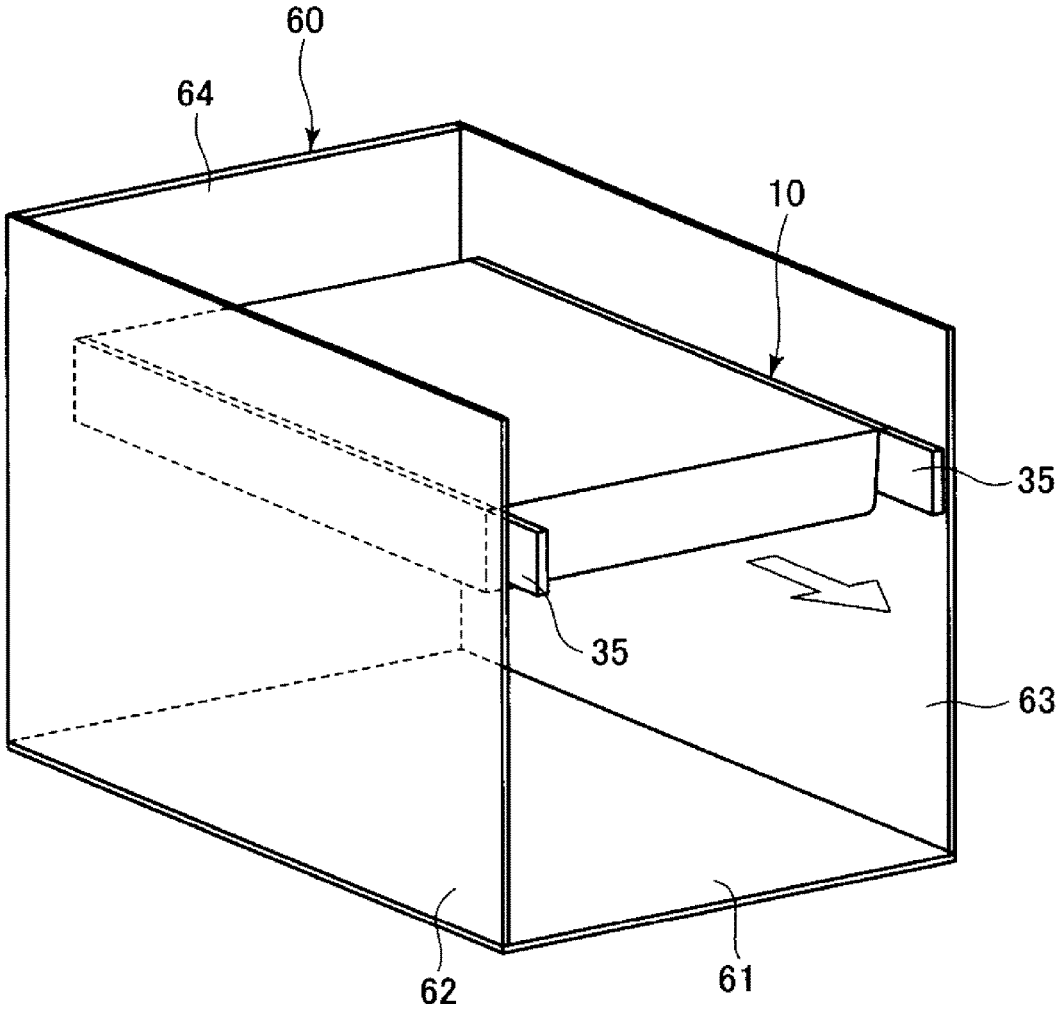
FIG. 3 is a schematic perspective view of a combination of the frame of the main assembly of the image forming apparatus, and the intermediary transfer belt unit.

FIG. 3 is a schematic perspective view of a combination of the frame 60 of the apparatus main assembly 110, and the unit 10, after the installation of the unit 10 into the apparatus main assembly 110. The main assembly frame 60 has: a bottom plate 61; front and rear plates 62 and 63 erected from the front and rear edges of the bottom plate 61, respectively; and a side plate 64 which connects the front and rear plates 62 and 63 on the left side of the main assembly frame 60. Further, referring to FIG. 1, the unit 10 is provided with a door 65, which is attached to the front and rear plates 62 and 63 in such a manner that it can be rotatably moved about a shaft 18 from the right side of the apparatus main assembly 110, in the direction to expose the sheet passage through which a sheet S of transfer medium is conveyed from the sheet feeding-conveying device 20 to the fixing device 17, or in the direction to enclose the sheet passage. Thus, the unit 10 can be moved out of the apparatus main assembly 110 by opening the door 65 and pulling the unit 10 rightward of the apparatus main assembly 110 as indicated by an arrow mark in FIG. 3, or can be installed into the apparatus main assembly 110 by opening the door 65 and inserting the unit 10 into the apparatus main assembly 110 in the leftward direction, that is, in the opposite direction from the direction indicated by the arrow mark in FIG. 3.

Figure 4:
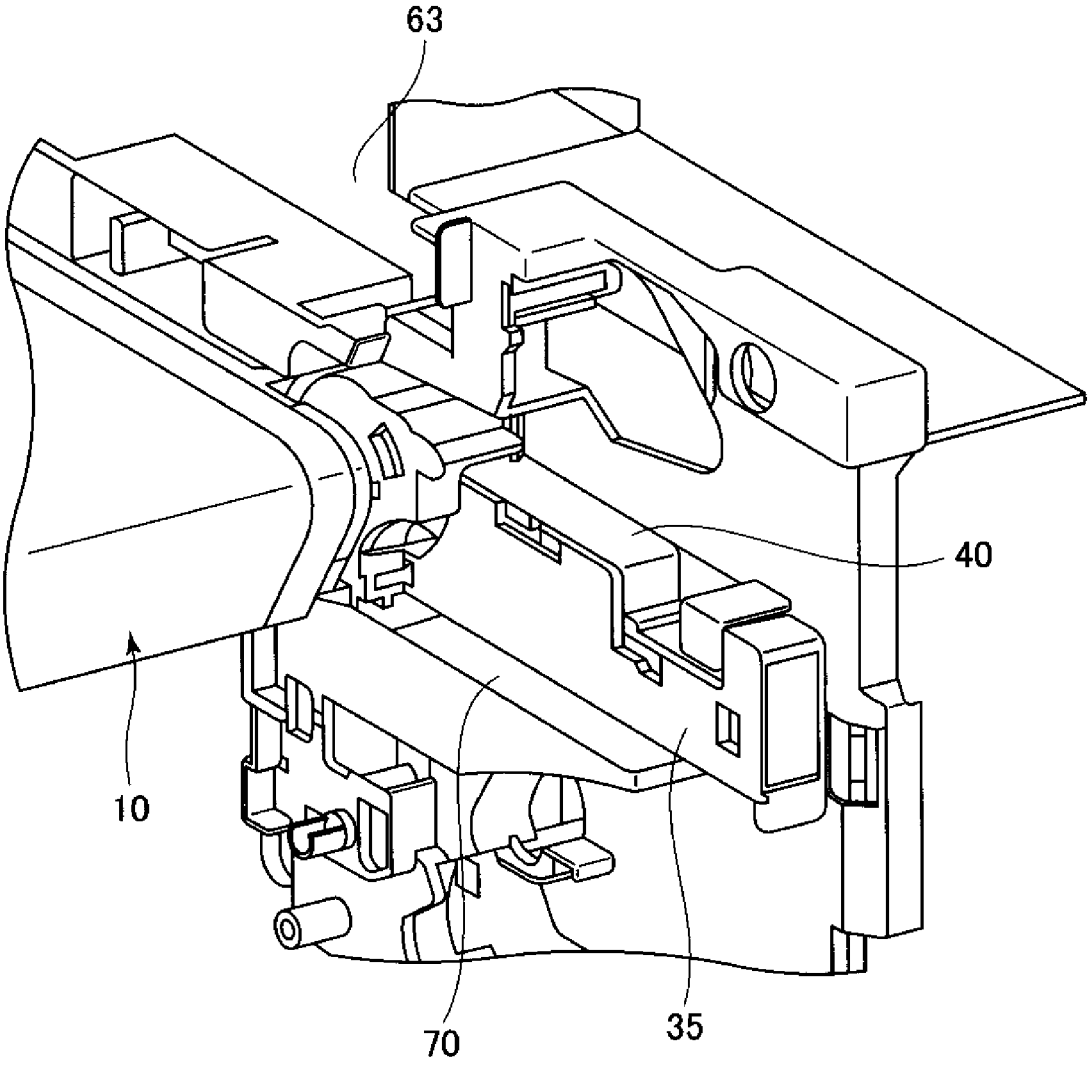
FIG. 4 is a perspective view of the handle of the intermediary transfer belt unit, and its adjacencies, when the intermediary transfer belt unit is properly situated in the main assembly of the image forming apparatus.
Figure 5:
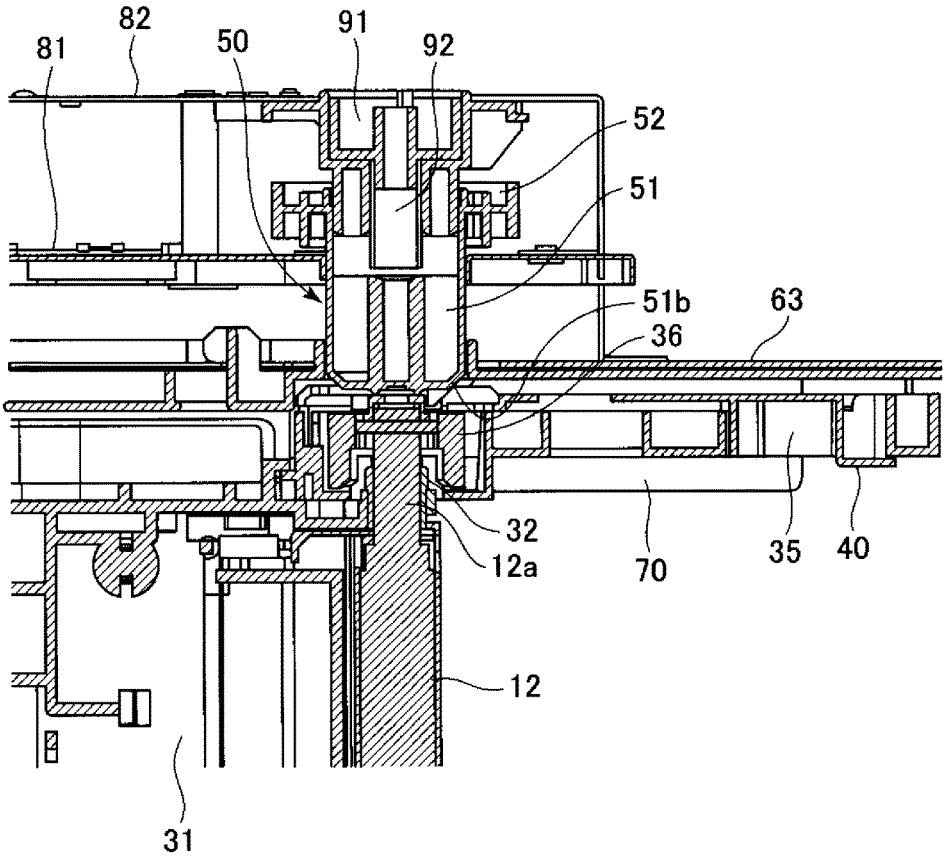
FIG. 5 is a horizontal sectional view of the handle of the intermediary transfer belt unit and its adjacencies, after the proper installation of the intermediary transfer belt unit into the main assembly of the image forming apparatus.

FIG. 4 is a perspective view of a combination of the rear handle 35 of the unit 10 and its adjacencies after the proper installation of the unit 10 into the apparatus main assembly 110. FIG. 5 is a horizontal sectional view of the rear handle 35 of the unit 10 and its adjacencies after the proper installation of the unit 10 into the apparatus main assembly 110.

Referring to FIG. 4, there are a pair of rails 70 (FIG. 4 shows only rear rail 70) attached to the front and rear plates 62 and 63, respectively. Thus, the unit 10 can be installed (slid) into, or uninstalled (slid) out of, the apparatus main assembly 110 in the direction which is roughly parallel to the surface of the front plate 62 and the surface of the rear plate 63, and also, in the roughly horizontal direction, while being guided by the pair of rails 70.

Next, referring to FIG. 5, the rear shaft 12*a* (to which driving force is transmitted) of the driver roller 12 in terms of the direction parallel to the rotational axis of the driver roller 12 is provided with a coupling 36 (which hereafter will be referred to simply as unit coupling), which is practically coaxial with the shaft 12*a* of the driver roller 12 and is rotatable with the shaft 12*a*. Thus, after the proper installation of the unit 10 into the apparatus main assembly 110, the unit coupling 36 is rotatable about its rotational axis which is roughly perpendicular to the surface of the rear plate 63. The rear end of the unit coupling 36 in terms of the direction parallel to the rotational axis of the unit coupling 36 has an engaging section 36*a* (FIG. 9) which engages with a coupling 50 (which hereafter will be referred to as main assembly coupling) with which the apparatus main assembly 110 is provided. The driving force is transmitted to the unit coupling 36 from the main assembly coupling 50, rotating thereby the unit coupling 36, and then, is inputted (transmitted) from the unit coupling 36 to the driver roller 12 as an object to be driven by the driving force.

The apparatus main assembly 110 is also provided with a first sub-frame 81 and a second sub-frame 82, which are attached to the rear plate 63 to support a drive train or the like for transmitting driving force to the main assembly coupling 50. The main assembly coupling 50 is supported by the first sub-frame 81, and a spring holder 91 attached to the second sub-frame 82. Not only is the unit coupling 36 rotatable about its rotational axis which is roughly perpendicular to the surface of the rear plate 63, but also, is allowed to move (slide) in the direction which is parallel to the rotational axis of the unit coupling 36. Further, a coupling spring 92, which is a compression spring, is disposed in a compressed state, between the main assembly coupling 50 and spring holder 91. Thus, the main assembly coupling 50 remains pressed frontward, that is, toward the unit 10, in the direction which is roughly perpendicular to the surface of the rear plate 63. As will be described later in detail, the main assembly coupling 50 can be moved away (retracted) from the unit 10, against the resiliency of the coupling spring 92, to be disengaged from the unit coupling 36. The main assembly coupling 50 is made up of a front section 51, which is an engaging section, and a rear section 52, which is a gear section. The engaging section 51 is roughly cylindrical. The spring holder side, that is, the rear side (gear section 52) of the main assembly coupling 50 is greater in external diameter than the front side (engaging section 51) of the main assembly coupling 50. The front end of the main assembly coupling 50 in terms of the direction parallel to the axial line of the main assembly coupling 50 is an engaging section 51*a* (FIG. 10), which engages with the unit coupling 36. The main assembly coupling 50 is rotated by the driving force inputted into the gear section 52 of the main assembly coupling 50 through the gear train from the intermediary transfer belt driving motor (unshown), as a driving force source, with which the apparatus main assembly 110 is provided. As the main assembly coupling 50 is rotated, it rotates the unit coupling 36 which is in engagement with the unit coupling 36, by transmitting the driving force to the unit coupling 36.

As the unit 10 is properly installed into the apparatus main assembly 110, the rotational axis of the main assembly coupling 50 becomes practically coincidental with the rotational axis of the unit coupling 36. Then, the main assembly coupling 50 protrudes toward the unit 10 in the direction which is parallel to its rotational axis, and engages with the unit coupling 36. Thus, the engaging section of the unit 10 and that of the main assembly coupling 50 practically coaxially rotate.

Further, the main assembly coupling 50 is provided with a tapered section 51*b*, which is tapered so that the farther it is from the unit 10 in terms of the direction of the rotational axis of the main assembly coupling 50, the greater the diameter of the tapered section 51*b*. That is, the engaging section 51 of the main assembly coupling 50 is roughly in the form of such a truncated cone that its unit facing side is smaller in diameter than its base side.

Moreover, the unit 10 is provided with a disengaging component 40 which can cause the main assembly coupling 50 to retract from the unit 10 to enable the unit 10 to be installed into, or moved out of, the apparatus main assembly 110. The disengaging component 40 is disposed so that as the unit 10 is inserted into the apparatus main assembly 110, the disengaging component 40 will be between the main assembly coupling 50 and unit coupling 36 to allow the two couplings 50 and 36 to engage with each other.

Figure 6:
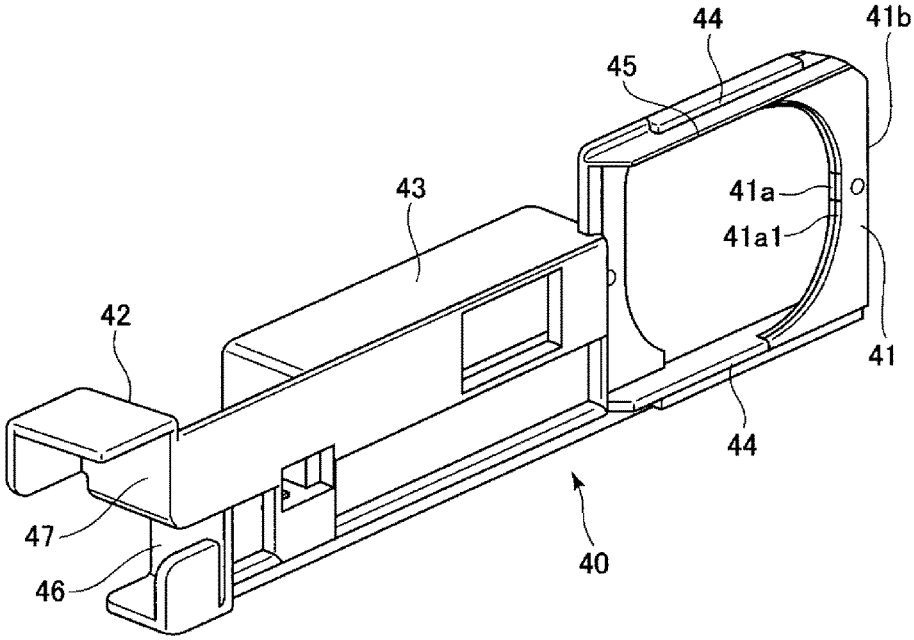
FIG. 6 is a perspective view of the disengaging component.

FIG. 6 is a perspective view of the disengaging component 40 as seen from the right-hand side of the apparatus main assembly 110. Referring to FIG. 6, the disengaging component 40 is roughly in the form of a long and narrow plate or rod. One of its lengthwise ends is a disengaging section 41, and the other lengthwise end is the handhold section 42. The section between the disengaging section 41 and handhold section 42 is the main section 43. As will be described later in detail, the main section side of the disengaging section 41 in terms of the lengthwise direction of the disengaging component 40 is the first contacting section 41*a* which comes into contact with the slanted surface 51*b* of the truncated-cone-like section of the main assembly coupling 50 when the unit 10 is pulled out of the apparatus main assembly 110. Further, as will be described later in detail, the opposite side of the disengaging section 41 from the main section 43 in terms of the lengthwise direction of the disengaging component 40 is the second contacting section 41*b* which comes into contact with the slanted surface 51*b* of the truncated-cone-like section of the main assembly coupling 50 when the unit 10 is inserted into the apparatus main assembly 110. The disengaging section 41 is connected to the main section 43 by a connective section 44. The opposite end of the main section 43 from the connective section 44 is the handhold section 42. That is, the disengaging section 41, handhold section 42, and main section 43 are integral parts of the disengaging component 40.

The disengaging component 40 is attached to the rear handle 35 of the unit 10. The disengaging component 40 can be moved (slid) on the handle 35 in the direction in which the unit 10 is inserted into, or moved out of, the apparatus main assembly 110. That is, the disengaging component 40 is disposed in such an attitude that its lengthwise direction is parallel to the direction in which the unit 10 is inserted into, or moved out of, the apparatus main assembly 110, that is, its lengthwise direction is roughly perpendicular to the rotational axis of the unit coupling 36. Thus, the disengaging component 40 can be operated (moved) with the use of the handle 35 which is grasped when the unit 10 is installed into, or removed from, the apparatus main assembly 110. It is movable in the direction which is parallel to the direction in which the unit 10 is moved relative to the apparatus main assembly 110 when the unit 10 is inserted into, or moved out of, the apparatus main assembly 110. The disengaging section 41 of the disengaging component 40 is positioned so that after the proper installation of the unit 10 into the apparatus main assembly 110, the disengaging section image formation unit 41 will be on the inward side of the apparatus main assembly 110 relative to the rotational axis of the unit coupling 36, whereas the handhold section 42 and main section 43 will be on the outward side of the apparatus main assembly 110 relative to the rotational axis of the unit coupling 36. As for the connective section 44, it is positioned so that after the proper installation of the unit 10 into the apparatus main assembly 110, it will straddle the rotational axis of the unit coupling 36. That is, the disengaging component 40 extends from the adjacencies of the unit coupling 36 to the adjacencies of the end of the handle 35. Moreover, the disengaging component 40 is provided with a hole 45 which is surrounded by the disengaging section 41, main section 43, and connective section 44, and the position of which corresponds to that of the unit coupling 36. Thus, after the proper installation of the unit 10 into the apparatus main assembly 110, the disengaging component 40 does not interfere with the engagement between the unit coupling 36 and main assembly coupling 50.

Figure 7:
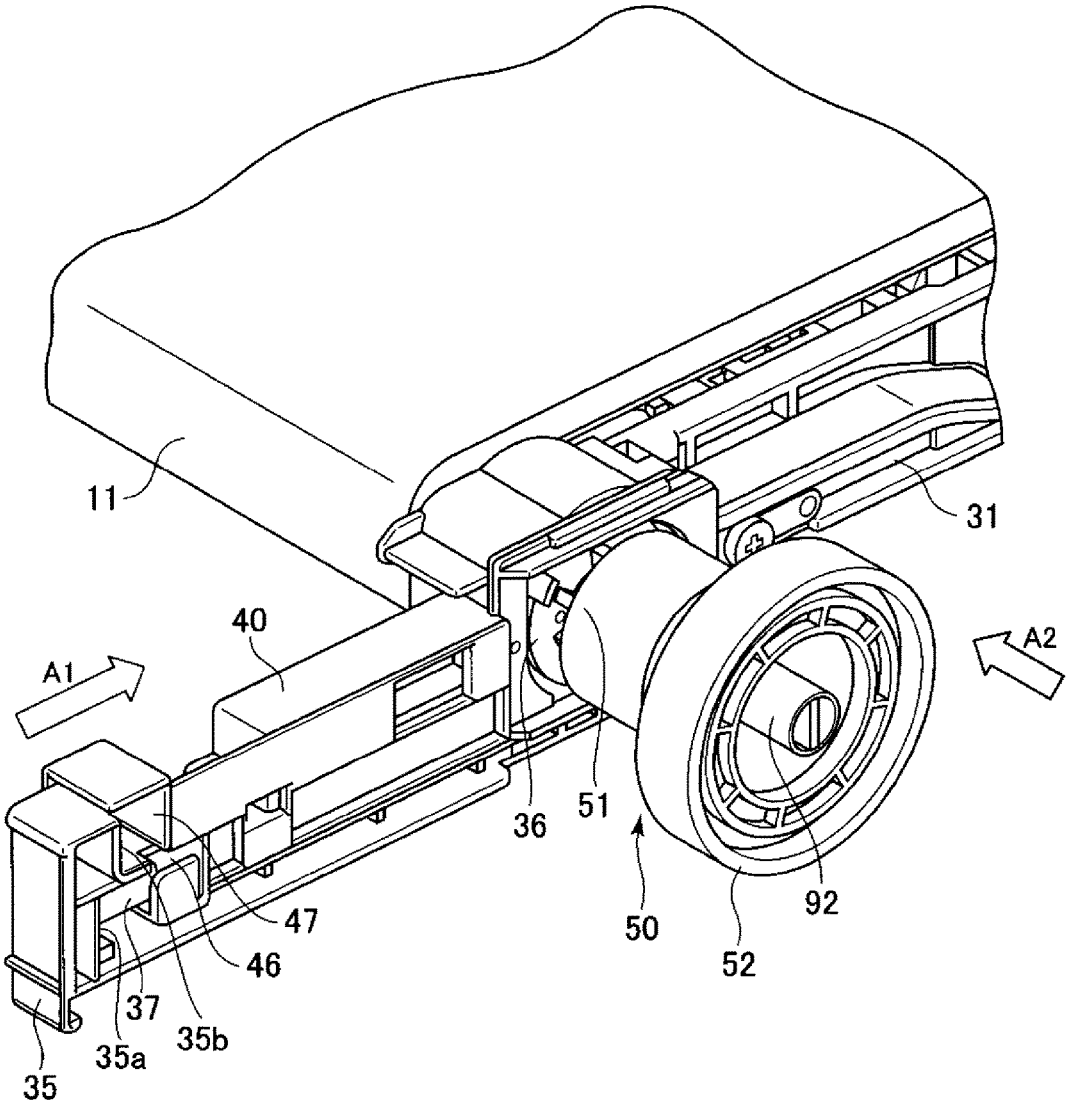
FIG. 7 is a perspective view of a combination of the intermediary transfer belt unit and coupling section of the main assembly of the image forming apparatus, after the proper installation of the intermediary transfer belt unit into the main assembly.
Figure 8:
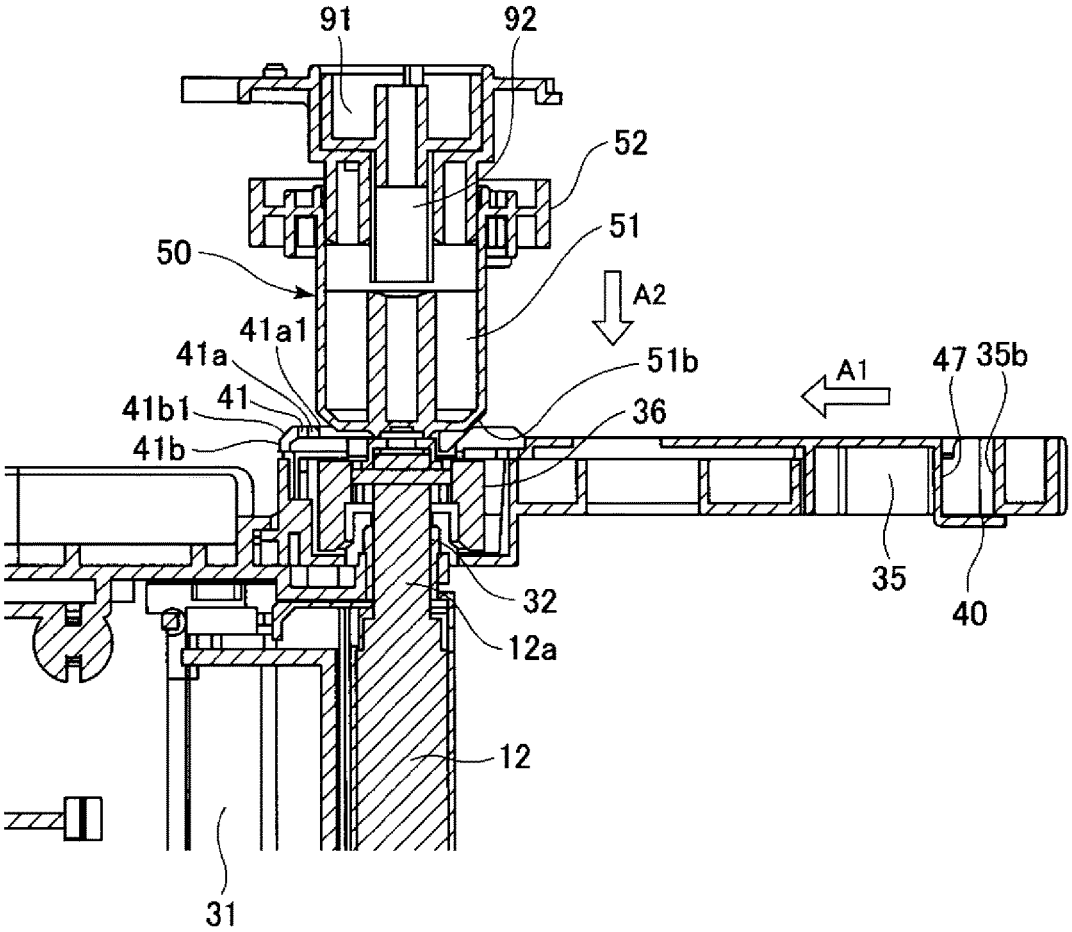
FIG. 8 is a horizontal sectional view of the intermediary transfer belt unit and the coupling section of the main assembly of the image forming apparatus, after the proper installation of the intermediary transfer belt unit into the main assembly of the image forming apparatus.

FIGS. 7 and 8 are perspective and horizontal sectional views, respectively, of a combination of the unit coupling 36, disengaging component 40, and main assembly coupling 50 after the proper installation of the unit 10 into the apparatus main assembly 110. Referring to FIG. 7, the disengaging component 40 is disposed so that after the proper installation of the unit 10, it is sandwiched between the unit coupling 36 and main assembly coupling 50. Further, the disengaging component 40 is kept pressed leftward of the apparatus main assembly 110, that is, the direction indicated by an arrow mark A1 in the drawing (direction in which unit 10 is inserted into apparatus main assembly 110), by a handle spring 37, as a pressure applying means, which is a compression spring. The handle spring 37 is disposed, in a compressed state, between the spring seat section 35*a* of the handle 35 and the spring seat section fixing device 46 of the disengaging component 40. Further, the main assembly coupling 50 is kept pressed toward the unit coupling 36, that is, in the direction indicated by an arrow mark A2 in the drawing. Thus, after the proper installation of the unit 10 into the apparatus main assembly 110, the main assembly coupling 50 remains engaged with the unit coupling 36. Also after the proper installation of the unit 10 into the apparatus main assembly 110, the disengaging component 40 is in such a position that the first contacting section 41*a* of the disengaging section 41 is in the adjacencies of the slanted surface 51*b* of the truncated cone-like section of the main assembly coupling 50.

Figure 9:
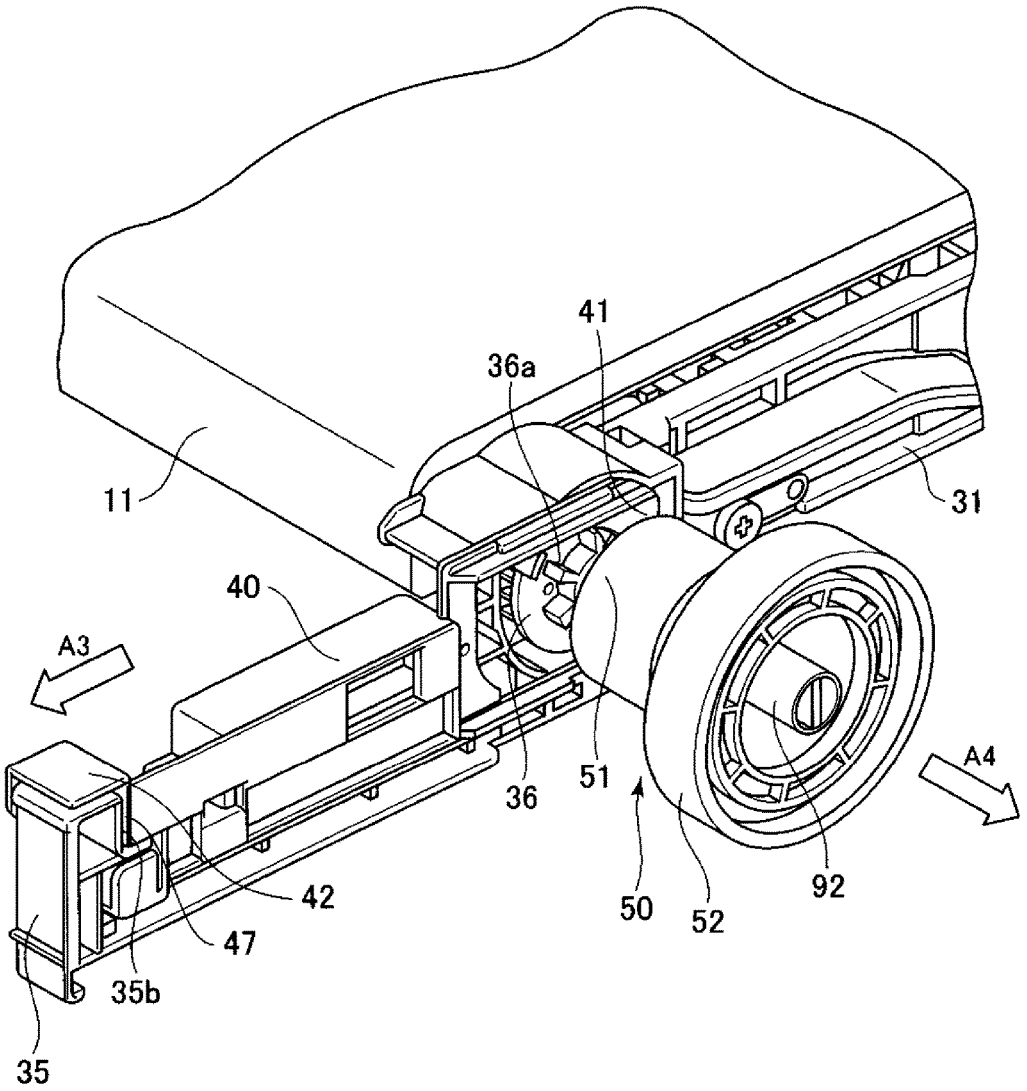
FIG. 9 is a perspective view of the intermediary transfer belt unit and the coupling section of the main assembly of the image forming apparatus, right after the pulling of the disengaging component.
Figure 10:
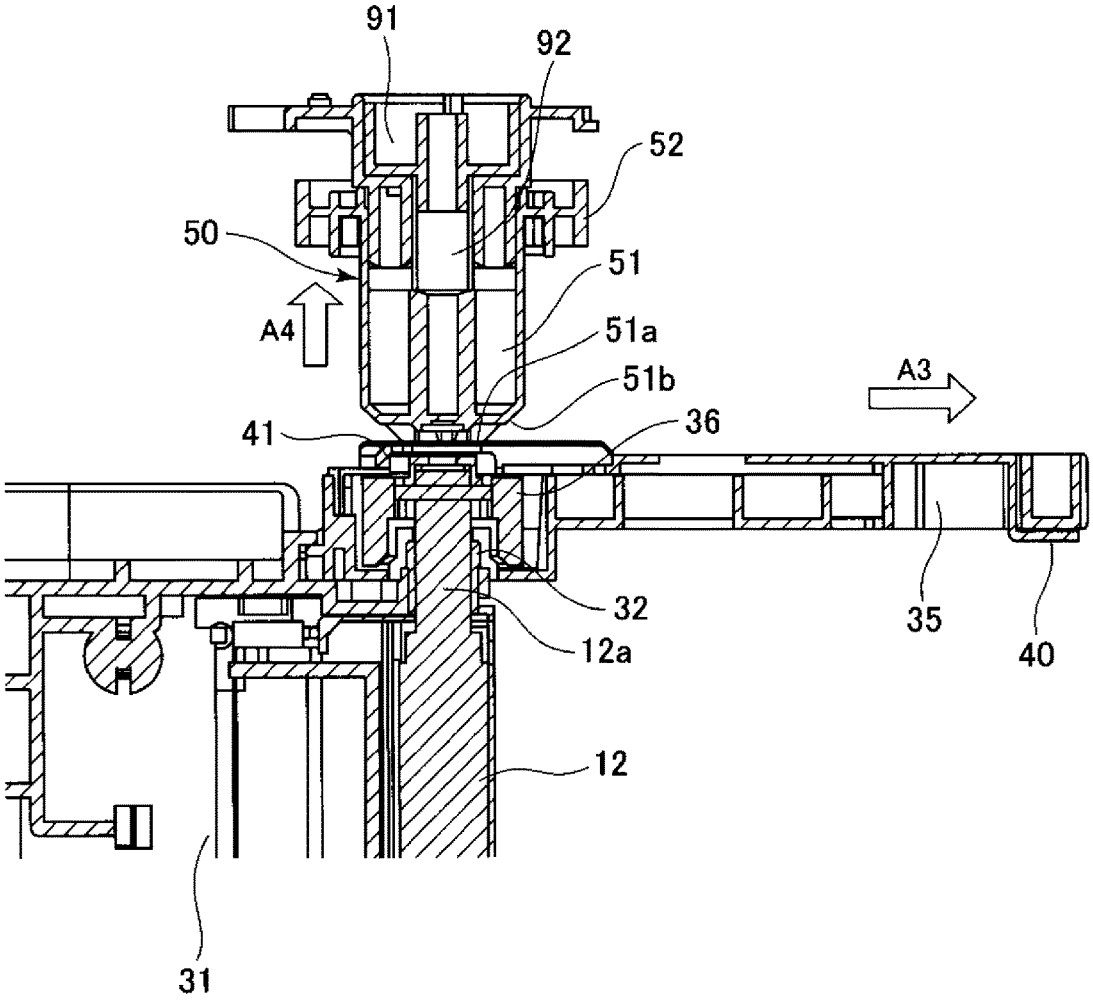
FIG. 10 is a horizontal sectional view of the intermediary transfer belt unit and the coupling section of the main assembly of the image forming apparatus, right after the pulling of the disengaging component.

FIGS. 9 and 10 are perspective view and horizontal sectional view, respectively, of the unit coupling 36, disengaging component 40, and main assembly coupling 50 when the unit 10 is pulled out of the apparatus main assembly 110. Referring to FIG. 9, as the unit 10 is pulled in the direction indicated by an arrow mark A3 to move the unit 10 out of the apparatus main assembly 110, by the handhold section 42 of the disengaging component 40, the disengaging component 40 is made to slide on the handle 35, against the resiliency of the hand spring 37, until the bumper section 47 of the disengaging component 40 comes into contact with the stopper section 35*b* of the handle 35. During this movement of the disengaging component 40, the first contacting section 41*a* of the disengaging section 41 of the disengaging component 40 comes into contact with the slanted surface 51*b* of the truncated-cone-like section of the main assembly coupling 50, and slides on the slanted surface 51*b* of the truncated cone-like section, as shown in FIG. 10. Thus, the main assembly coupling 50 is made to move in the direction indicated by an arrow mark A4 in the drawing, that is, the direction to move away from the unit 10. Consequently, the main assembly coupling 50 is disengaged from the unit coupling 36, and is moved further away from the unit 10. Thus, the unit 10 can be moved out of the apparatus main assembly 110 by pulling the unit 10 by the handle 35 in the direction indicated by the arrow mark A3, that is, the direction which is roughly perpendicular to the rotational axis of the unit coupling 36. By the way, the main assembly coupling 50 slides up onto the disengaging section 41 of the disengaging component 40, and then, is made to protrude toward the unit 10 by the pressure from the coupling spring 92 after the passage of the disengaging section 41 (FIG. 12).

Figure 11:
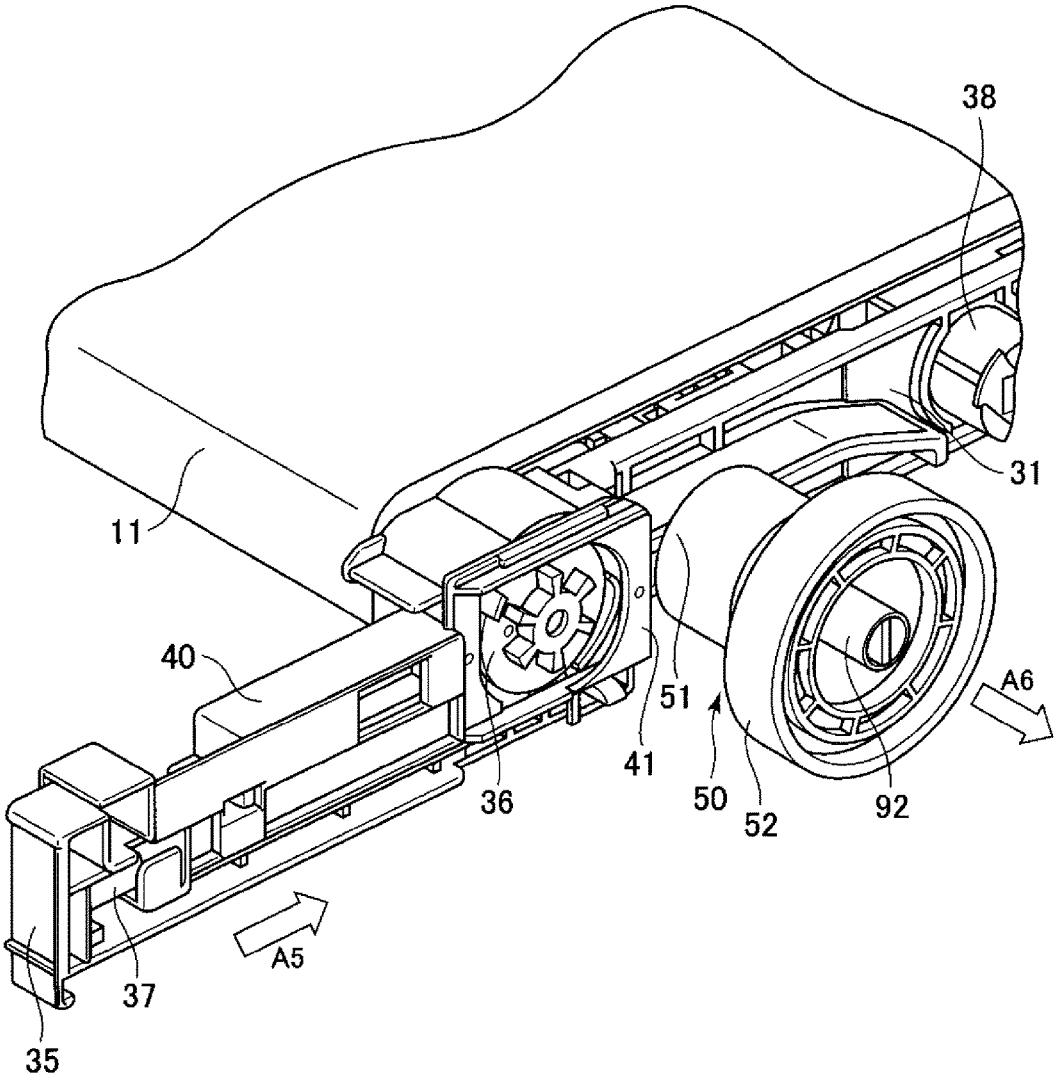
FIG. 11 is a perspective view of the intermediary transfer belt unit and the coupling section of the main assembly of the image forming apparatus, during the insertion of the intermediary transfer belt unit into the main assembly.
Figure 12:
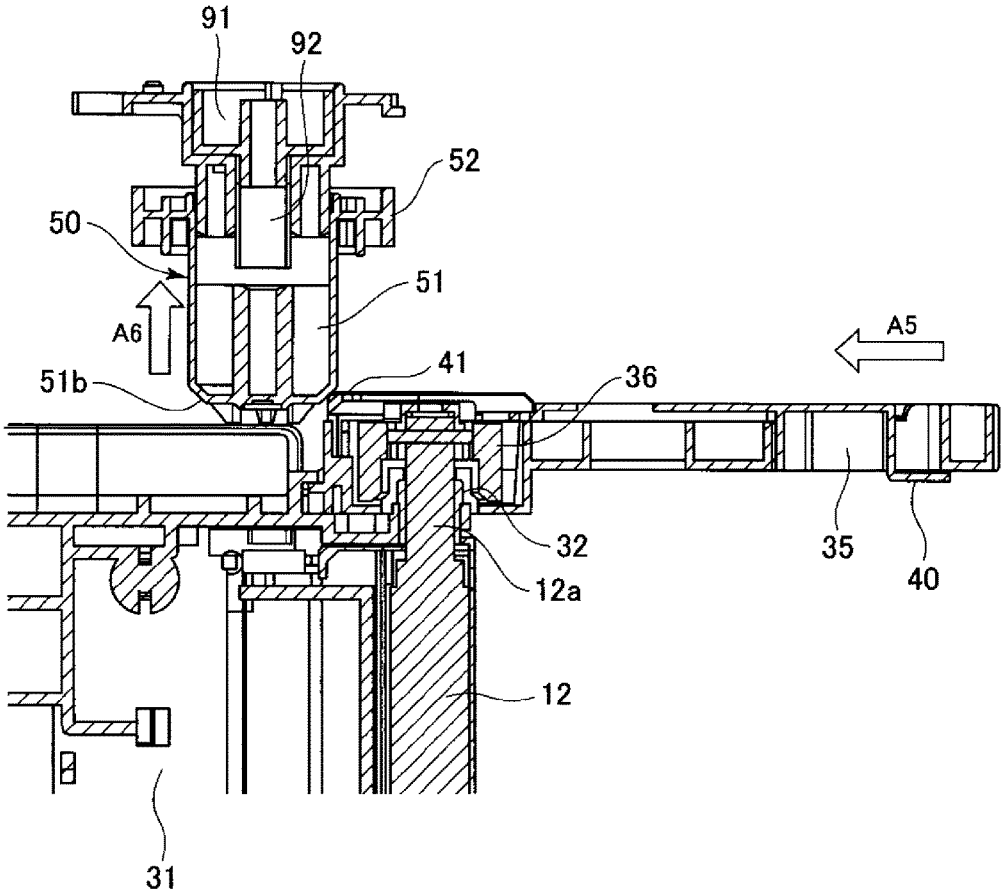
FIG. 12 is a horizontal sectional view of the intermediary transfer belt unit and the coupling section of the main assembly of the image forming apparatus, during the insertion of the intermediary transfer belt unit into the main assembly.

FIGS. 11 and 12 are perspective view and horizontal sectional view, respectively, of the combination of the unit coupling 36, disengaging component 40, and main assembly coupling 50 during the insertion of the unit 10 into the apparatus main assembly 110. Referring to FIG. 11, the main assembly coupling 50 is kept protrusive toward the unit 10 by the pressure from the coupling spring 92. It is in the state in which the combination is that an operator is to insert the unit 10 into the apparatus main assembly 110 in the leftward direction of the apparatus main assembly 110, indicated by an arrow mark A5 in the drawings, that is, the direction which is roughly perpendicular to the rotational axis of the unit coupling 36, by holding the handles 35. As the unit 10 is inserted, the second contacting section 41*b* of the disengaging section 41 of the disengaging component 40 comes into contact with the slanted surface 51*b* of the truncated-cone-like section of the main assembly coupling 50, and slides on the slanted surface 51*b*, as shown in FIG. 12. Thus, the main assembly coupling 50 is caused to move in the direction indicated by an arrow mark A6 in the drawings, that is, the direction to move away from the unit 10. That is, the main assembly coupling 50 is caused to retract away from the unit 10. Thus, the unit 10 can be inserted further into the apparatus main assembly 110 so that it will settle into a preset unit position in the apparatus main assembly 110. As for the main assembly coupling 50, it slides onto the disengaging section 41 of the disengaging component 40. Then, after the passage of the disengaging section 41, it is caused to engage with the unit coupling 36 by the pressure from the coupling spring 92 (FIG. 8).

As described above, in this embodiment, the main assembly coupling 50 is made retractable away from the unit 10. Further, its protrusive end portion is tapered. Further, the unit 10 is provided with the disengaging component 40 which is movable in the direction which is roughly perpendicular to the direction in which the main assembly coupling 50 is retractable. Thus, as the handle 35 is pushed inward of the apparatus main assembly 110, the first contacting section 41*a* of the disengaging section 41 of the disengaging component 40 comes into contact with the slanted surface 51*b* of the tapered section of the main assembly coupling 50, and slides on the slanted surface 51*b*, causing thereby the main assembly coupling 50 to retract from the unit 10. That is, the main assembly coupling 50 and unit coupling 36 can be disengaged from each other with the use of only a single component (disengaging component 40). In other words, the means for disengaging the main assembly coupling 50 from the unit coupling 36 is simple in structure, and yet, reliable. Therefore, not only is it significantly less in cost than any conventional means, but also, it is less likely to suffer from the malfunction which is attributable to structural complication. Moreover, unless the disengaging component 40 is accessed, the apparatus main assembly 110 and unit 10 do not disengage from each other. Therefore, it does not occur that the unit 10 unexpectedly falls out of the apparatus main assembly 110. Further, all that is necessary to cause the main assembly coupling 50 to retract from the unit 10 is to push the unit 10 into the apparatus main assembly 110 by the handles 35 of the unit 10 so that the second contacting section 41*b* of the disengaging section 41 of the disengaging component 40 comes into contact with the slanted surface 51*b* of the tapered section of the main assembly coupling 50, and slides on the slanted surface 51*b*. That is, the image forming apparatus 100 (apparatus main assembly 110) and unit 10 in this embodiment are simple in structure, and yet, enable the unit 10 to be easily installed into the apparatus main assembly 110.

By the way, referring to FIG. 6, the first contacting portion 41*a* of the disengaging section 41 of the disengaging component 40 may be chamfered (it may be given slanted surface 41*a*1) so that the unit 10 can be more smoothly pulled out of the apparatus main assembly 110 than in a case where the first contacting portion 41*a* is pointed (not chamfered). In such a case, the first contacting section 41*a* is chamfered so that the resultant slanted surface 41*a*1 is angled in the same direction as the slanted surface 51*b* of the tapered (truncated-cone-like) section of the main assembly coupling 50. Next, referring to FIG. 8, the second contacting section 41*b* of the disengaging section 41 of the disengaging component 40 may also be chamfered to provide the second contacting section 41*b* with a slanted surface 41*b*1 so that the unit 10 can be more smoothly inserted into the apparatus main assembly 110 than in a case where the second contacting section 41*b* is pointed (not chamfered). In such a case, the second contacting section 41*b* is chamfered so that the resultant slanted surface 41*b*1 is angled on the same side as the slanted surface 51*b* of the tapered (truncated cone-like) section of the main assembly coupling 50 as it comes into contact with slanted surface 41*a*1. By the way, it may be only one of the first and second contacting sections 41*a*1 and 41*b*1 that is to be chamfered (provided with slanted surfaces 41*a*1 and 41*b*1, respectively). However, it is desired that both contacting sections are chamfered as in this embodiment.

Figure 13:
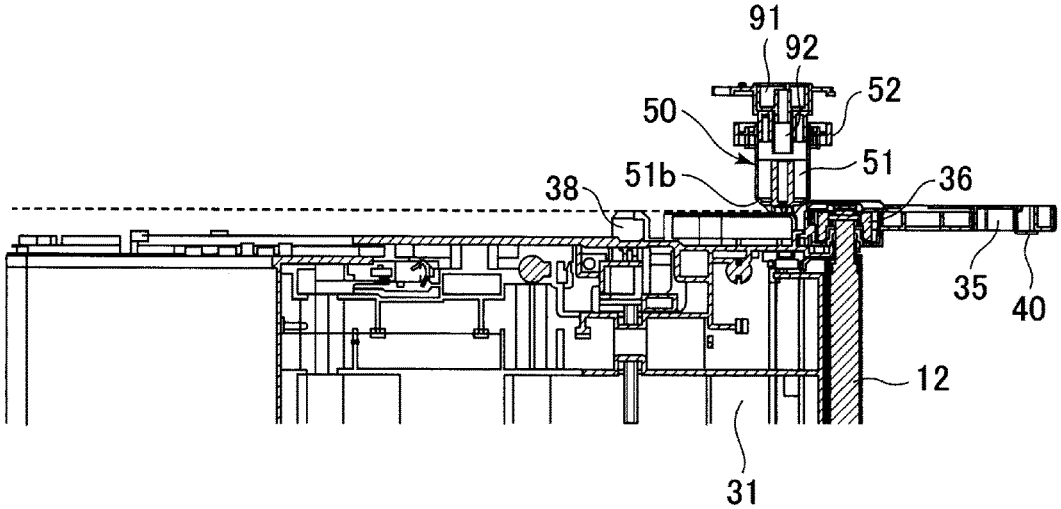
FIG. 13 is a horizontal sectional view of the rear end portion of the intermediary transfer belt unit.

FIG. 13 is a horizontal sectional view of the rear end portion of the unit 10. Prior to the installation of the unit 10 into the apparatus main assembly 110, the main assembly coupling 50 is kept protrusive toward the unit 10 by a certain distance by the coupling spring 92 compared to where it is after the installation of the unit 10. If the amount by which the main assembly coupling 50 protrudes is greater than a certain value, the main assembly coupling 50 collides with certain portions of the unit 10, making it possible for the unit 10 to be smoothly inserted into, or moved out of, the apparatus main assembly 110. In this embodiment, therefore, the unit 10 is structured so that the downstream side of the unit 10 relative to the disengaging component 40 in terms of the unit insertion direction has no section that is protrusive toward the main assembly coupling 50 beyond the tip of the main assembly coupling 50 when the main assembly coupling 50 is most protrusive. In this embodiment, the unit 10 is provided with a coupling 38 which is for inputting driving force into a switching mechanism (unshown) which presses the primary transfer roller 6 against the photosensitive drum 1 with the presence of the intermediary transfer belt 11 between the primary transfer roller 6 and photosensitive drum 1, or moves the primary transfer roller 6 away from the photosensitive drum 1. This coupling 38 is positioned most outward, with reference to the rotational axis (which is roughly perpendicular to direction in which unit 10 is inserted into, or pulled out, of apparatus main assembly 110) of the unit coupling 36, of all the sections of the unit 10, which are on the downstream side of the disengaging component 40 in terms of the unit insertion direction. In this embodiment, therefore, the measurement of the main assembly coupling 50 and that of the coupling 38 are set so that the tip of the main assembly coupling 50 does not interfere with the coupling 38 in terms of the thrust direction. Therefore, the unit 10 can be smoothly (without hanging up) installed into, or uninstalled from, the apparatus main assembly 110.

As described above, according to this embodiment, even in a case where the image forming apparatus 100 is structured so that the unit 10 is installed into, or removed from, the apparatus main assembly 110 in the direction which is intersectional to the rotational axis of the driver roller 12 of the unit 10, the main assembly coupling 50 and unit coupling 36 can be easily disengaged with the use of a simple structural arrangement.

Embodiment 2

Next, another embodiment of the present invention is described. The image forming apparatus in this embodiment is the same in basic structure and operation as the image forming apparatus in the first embodiment. Therefore, the elements of the image forming apparatus in this embodiment, which are the same in function or structure as the counterparts of the image forming apparatus in the first embodiment are given the same referential codes as those given to the counterparts, one for one, and are not described in detail.

In the first embodiment, the image forming apparatus 100 was structured so that the main assembly coupling 50 is retractable from the unit 10, and the unit 10 was provided with the disengaging component 40 for causing the main assembly coupling 50 to retract. In comparison, in this embodiment, the unit 10 is structured so that its unit coupling 36 is enabled to be retracted from the main assembly coupling 50 by a disengaging component 40 with which the unit 10 is provided. That is, in this embodiment, the unit 10 is provided with the entirety of the mechanism for disengaging the main assembly coupling 50 and unit coupling 36 from each other.

Figure 14:
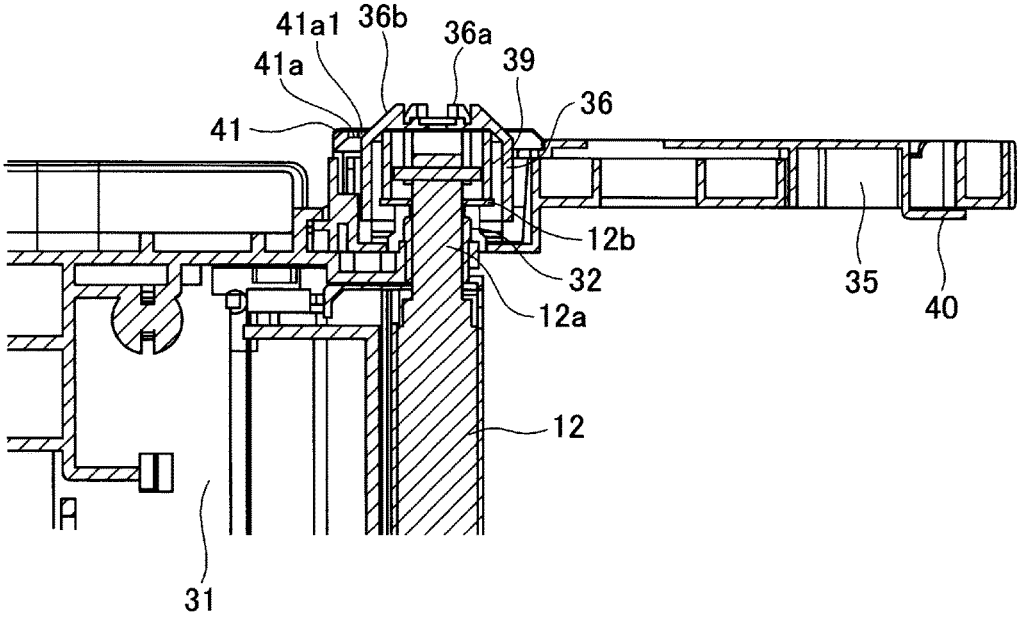
FIG. 14 is a horizontal sectional view of the handle of the intermediary transfer belt unit and its adjacencies, in another embodiment of the present invention, after the proper installation of the intermediary transfer belt unit into the main assembly of the image forming apparatus.

FIG. 14 is a horizontal sectional view of the rear handle 35 of the unit 10, and its adjacencies, in this embodiment. The unit coupling 36 is attached to the rear end of the drive shaft 12*a* of the driver roller 12 in terms of the direction parallel to the rotational axis of the driver roller 12. In this embodiment, not only can the unit coupling 36 rotate with the drive shaft 12*a* of the driver roller 12, but also, it is allowed to move (slide) in the direction parallel to the rotational axis of the driver roller 12. Thus, not only is the unit coupling 36 is rotatable about its rotational axis which is roughly perpendicular to the rear plate 63, but also, is movable in the direction parallel to the rotational axis of the driver roller 12. Further, this unit coupling 36 is kept pressed outward of the unit 10 in terms of the direction parallel to the rotational axis of the driver roller 12, by the coupling spring 39, as a pressure applying means, which is a compression spring. The coupling spring 39 is disposed, in a compressed state, between the unit coupling 36 and a spring supporting section 12*b* with which the drive shaft 12*a* of the driver roller 12 is provided. Thus, the unit coupling 36 can be moved away from the main assembly coupling 50 against the resiliency of the coupling spring 39 to be disengaged from the main assembly coupling 50. That is, the unit coupling 36 can be retracted from the main assembly coupling 50.

By the way, as the unit coupling 36 protrudes when the unit 10 is not in the apparatus main assembly 110, it comes into contact with the disengaging component 40, being thereby prevented from falling out of the unit 10. Further, in this embodiment, the main assembly coupling 50 is attached to the apparatus main assembly 110 in such a manner that it is not movable in the direction parallel to its rotational axis.

Moreover, in this embodiment, the rear end of the unit coupling 36 in terms of the direction parallel to the axial line of the unit coupling 36 is chamfered in such a manner that the farther it is from the main assembly coupling 50, the larger it is in the diameter; the rear end has a tapered, having a slanted surface 36*b*. That is, the end portion of the unit coupling 36, which is on the main assembly coupling (50) side, is roughly in the form of a truncated cone, which is tapered so that its main assembly coupling 50 side is smaller in diameter than its base side. Further, a disengaging component 40 which is similar to that in the first embodiment is attached to the handle 35 in such a manner that it is allowed to move (slide) relative to the handle 35.

Figure 15:
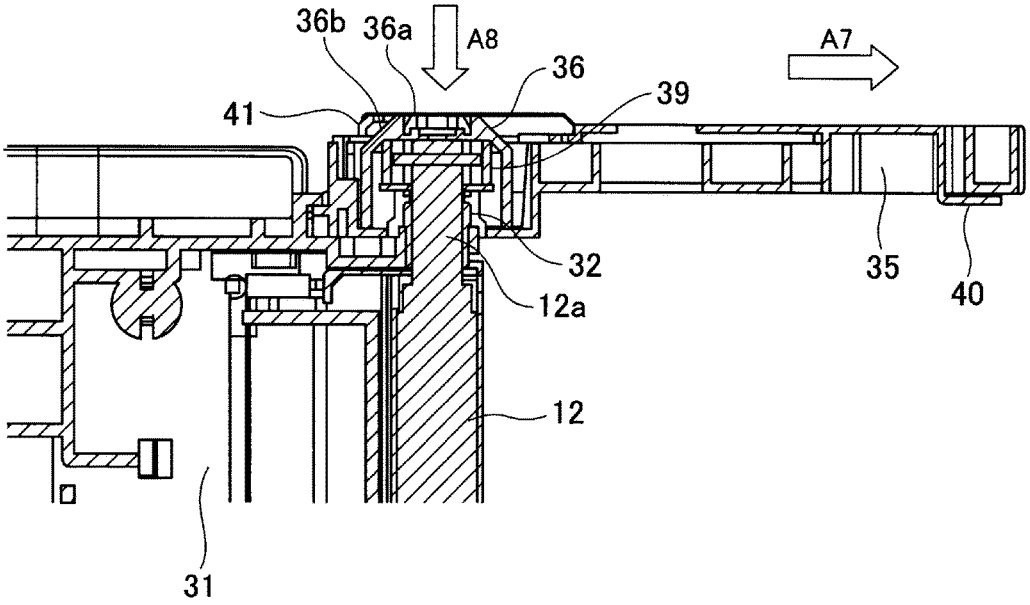
FIG. 15 is a horizontal sectional view of the coupling section of the intermediary transfer belt unit and the disengaging component of the belt unit, in the second embodiment, after the pulling of the disengaging component.

FIG. 15 is a horizontal sectional view of a combination of the unit coupling 36 and disengaging component 40 in this embodiment after the disengaging component 40 was pulled to install the unit 10 into the apparatus main assembly 110, or uninstall the unit 10 from the apparatus main assembly 110. For example, if an operator wants to pull the unit 10 out of the apparatus main assembly 110, the operator is to pull the disengaging component 40 by the handhold section 42 in the direction indicated by an arrow mark A7 in the drawing, that is, the direction in which the unit 10 is to be pulled out of the apparatus main assembly 110. As the disengaging component 40 is pulled in the above-described direction, the contacting section 41*a* of the disengaging section 41 of the disengaging component 40 comes into contact with the slanted surface 36*b* of the tapered section of the unit coupling 36, and slides on the slanted surface 36*b*. Thus, the unit coupling 36 is made to move in the direction indicated by an arrow mark A8, that is, the direction to move away from the main assembly coupling 50. In other words, the unit coupling 36 is retracted from the main assembly coupling 50, being thereby disengaged from the main assembly coupling 50. After the complete retraction of the unit coupling 36, the operator is to pull the unit 10 by the handles 35 in the direction (rightward of apparatus main assembly 110) indicated by the arrow mark A7, that is, the direction which is roughly perpendicular to the rotational axis of the unit coupling 36, in order to take the unit 10 out of the apparatus main assembly 110.

Moreover, in this embodiment, when it is necessary to install the unit 10 into the apparatus main assembly 110, first, the disengaging component 40 is to be moved as described above to retract the unit coupling 36 from the main assembly coupling 50, and then, the unit 10 is to be inserted into the apparatus main assembly 110. As the unit 10 is moved into the preset position for the unit 10 in the apparatus main assembly 110, where the rotational axis of the unit coupling 36 becomes practically coincidental to that of the main assembly coupling 50, the unit coupling 36 is to be released from the disengaging component 40 to allow the unit coupling 36 to engage with the main assembly coupling 50.

As described above, this embodiment can provide the same effect as the first embodiment. In addition, it is only the unit 10 that needs to be devised in structure to keep the unit coupling 36 disengaged from the main assembly coupling 50 to allow the unit 10 to be installed into, or removed from, the apparatus main assembly 110.

Miscellanies

In the foregoing, the present invention was described with reference to a couple of its embodiments. However, these embodiments are not intended to limit the present invention in scope.

In the above-described embodiments, the unit which was removably installable in the apparatus main assembly was the intermediary transfer belt unit, for example. However, the application of the present invention is not limited to an image forming apparatus which employs an intermediary transfer belt unit which is removably installable in the main assembly of the image forming apparatus. For example, the present invention is also compatible with an image forming apparatus of the so-called direct transfer type, which employs a transfer medium conveying component which is also an endless belt, like the intermediary transfer belt in the above-described embodiments, and bears and conveys a sheet of transfer medium onto which a toner image is transferred from an image bearing component. That is, the present invention is also applicable to a transfer medium bearing belt unit having a transfer medium bearing belt. That is, the present invention is applicable, with desirable results, to any unit which is equipped with an endless belt which directly bears a toner image, or indirectly bears a toner image, with the presence of transfer medium between itself and a toner image, and the driver roller of which is driven by the driving force transmitted thereto from the apparatus main assembly. Further, the component which is driven by the driving force from the apparatus main assembly is not limited to a driver roller which drives an endless belt such as an intermediary transfer belt and a transfer medium bearing belt. That is, the present invention is applicable to any unit which has a component to which driving force is transmitted from a driving force source, and which is removably installable into the main assembly of an apparatus. The results of such application are the same as those of the preceding embodiment. For example, a unit which is removably installable into the main assembly of an apparatus may be a cartridge having a photosensitive drum as a component to be driven, or a fixing device or the like having a fixation roller and/or pressure roller, which are to be driven by the driving force transmitted thereto from the apparatus main assembly.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-266603 filed on Dec. 26, 2014, which is hereby incorporated by reference herein in its entirety.

What is claimed is:

1. An image forming apparatus comprising:

a main assembly;

a driving source provided in said main assembly;

a first coupling provided in said main assembly and rotatable by a driving force from said driving source, said first coupling is capable of transmitting the driving force by an engaging portion provided at an end portion thereof in a first direction which is a direction of a rotational axis of said first coupling and being movable in the first direction, said first coupling being provided at a side surface of said engaging portion with a coupling taper surface having a diameter which increases in the first direction from a free end portion toward said driving source; and a unit detachably mountable to said main assembly in a second direction crossing with the first direction, said unit including a second coupling, a driven member and a releasing member, wherein said second coupling is rotatable and is disposed such that when said unit is mounted to said main assembly in a mounted position, a rotational axis of said second coupling and the rotational axis of said first coupling are substantially coaxial with each other, and said second coupling includes, at an end portion thereof with respect to a direction of the rotational axis of said second coupling, a portion-to-be-engaged engageable with said engaging portion to transmit the driving force from said driving source, wherein said driven member receives the driving force from said second coupling, and wherein said releasing member is movable relative to said second coupling in a direction crossing with the direction of the rotational axis of said second coupling member, and wherein when said unit is in the mounted position, said releasing member in contact with said coupling taper surface moves in the second direction to move said first coupling away from said second coupling to effect disengagement between said engaging portion and said portion-to-be-engaged.

2. An image forming apparatus according to claim 1, wherein said releasing member is moved in interrelation with movement of a grip portion.

3. An image forming apparatus according to claim 1, wherein said releasing member includes a first contact portion which contacts a disengagement contact position of said coupling taper surface.

4. An image forming apparatus according to claim 3, wherein said first contact portion includes a first taper surface inclined relative to the first direction toward the same side as said coupling taper surface inclines at the disengagement contact position.

5. An image forming apparatus according to claim 1, wherein said releasing member includes a second contact portion which contacts at a mounting contact position of said coupling taper surface when said unit is mounted to said main assembly.

6. An image forming apparatus according to claim 5, wherein said second contact portion includes a second taper surface inclined relative to the first direction toward the same side as said coupling taper surface in the mounting contact position is inclined.

7. An image forming apparatus according to claim 1, wherein said unit includes an endless belt configured to carry a recording material carrying a toner image or configured to receive a toner image, wherein said driven member is a driving roller configured to drive said belt.

8. An image forming apparatus comprising:

a main assembly;

a driving source provided in said main assembly;

a first coupling provided in said main assembly and rotatable by a driving force from said driving source, said first coupling is capable of transmitting the driving force by an engaging portion provided at an end portion thereof in a first direction which is a direction of a rotational axis of said first coupling; and a unit detachably mountable to said main assembly in a second direction crossing with the first direction, said unit including a second coupling, a driven member and a releasing member, wherein said second coupling is rotatable and is movable in a direction of a rotational axis of said second coupling, and said second coupling is disposed such that when said unit is mounted to said main assembly in a mounted position, the rotational axis of said second coupling and the rotational axis of said first coupling are substantially coaxial with each other, said second coupling includes, at an end portion thereof with respect to the direction of the rotational axis of said second coupling, a portion-to-be-engaged engageable with said engaging portion to transmit the driving force from said driving source, wherein said second coupling is provided at a side surface of said portion-to-be-engaged with a coupling taper surface having a diameter increasing toward said unit from a free end portion in the first direction, wherein said driven member receives the driving force from said second coupling, and wherein said releasing member is movable relative to said second coupling in a direction crossing with the direction of the rotational axis of said second coupling, and wherein when said unit is in the mounted position, said releasing member in contact with said coupling taper surface moves in the second direction to move said second coupling away from said first coupling to effect disengagement between said engaging portion and said portion-to-be-engaged.

9. An image forming apparatus according to claim 8, wherein said releasing member is moved in interrelation with movement of a grip portion.

10. An image forming apparatus according to claim 8, wherein said releasing member includes a contact portion which contacts at a disengagement contact position of said coupling taper surface.

11. An image forming apparatus according to claim 10, wherein said contact portion includes a first taper surface inclined relative to the first direction toward the same side as said coupling taper surface inclines at the disengagement contact position.

12. An image forming apparatus according to claim 8, wherein said unit includes an endless belt configured to feed a recording material which is to carry a toner image or onto which a toner image is to be transferred, and wherein said driven member is a driving roller configured to drive said belt.

* * * * *